US007260851B1

(12) United States Patent
Milnark et al.

(10) Patent No.: US 7,260,851 B1
(45) Date of Patent: Aug. 28, 2007

(54) APRON AND METHOD FOR USING THE SAME

(76) Inventors: Henry D. Milnark, 11024 Wingate Dr., Auburn Township, OH (US) 44023; James E. Mecsko, 6345 Spanish Main, Apollo Beach, FL (US) 33572

( * ) Notice: Subject to any disclaimer, the term of this patent is extended or adjusted under 35 U.S.C. 154(b) by 347 days.

(21) Appl. No.: 10/858,123

(22) Filed: Jun. 1, 2004

(51) Int. Cl.
*A41D 13/04* (2006.01)

(52) U.S. Cl. ..... 2/52; 2/48; 2/51

(58) Field of Classification Search ..... 2/48, 2/51, 52, 908, 913, 914, 911, 912, 919, 114, 2/49.1–49.5, 50, 47, 457, 102, 901, 85, 87, 2/88; D2/860–864, 740
See application file for complete search history.

(56) References Cited

U.S. PATENT DOCUMENTS

| | | | | | |
|---|---|---|---|---|---|
| 823,777 | A | * | 6/1906 | Hatton | 2/51 |
| 1,193,545 | A | | 8/1916 | Hart | |
| 1,257,810 | A | * | 2/1918 | Clarke | 2/48 |
| 1,451,095 | A | * | 4/1923 | Greene | 2/51 |
| 1,501,066 | A | * | 7/1924 | Rutherford | 24/315 |
| 1,524,457 | A | | 1/1925 | Selander | |
| 1,628,433 | A | * | 5/1927 | Schilke | 2/52 |
| 1,657,868 | A | | 1/1928 | Segal | |
| 1,951,380 | A | | 3/1934 | Wagenfeld | |
| 2,315,972 | A | * | 4/1943 | Lindfelt | 2/51 |
| 2,366,393 | A | * | 1/1945 | Geisinger | 2/52 |
| 2,423,002 | A | | 6/1947 | Bray | |
| 2,697,223 | A | | 12/1954 | Geisinger | |
| 2,717,437 | A | | 9/1955 | De Mestral | |
| 3,009,235 | A | | 11/1961 | De Mestral | |
| 3,397,406 | A | * | 8/1968 | Leach | 2/96 |
| 3,815,153 | A | | 6/1974 | Vitol | |
| 3,883,898 | A | | 5/1975 | Byrnes, Sr. | |
| 3,953,893 | A | | 5/1976 | Byrnes, Sr. | |
| 4,014,045 | A | * | 3/1977 | Moyer | 2/51 |
| 4,030,139 | A | | 6/1977 | Sonntag | |
| 4,258,440 | A | * | 3/1981 | McGowan | 2/114 |
| 4,266,299 | A | | 5/1981 | Beal | |
| D281,638 | S | | 12/1985 | Thomas | |
| 4,697,286 | A | * | 10/1987 | Cho | 2/22 |
| 4,718,124 | A | * | 1/1988 | Sawicki et al. | 2/114 |
| 4,837,859 | A | | 6/1989 | Hamberg | |
| 4,850,051 | A | | 7/1989 | Hodge | |

(Continued)

OTHER PUBLICATIONS

Author Unknown, "Cooking Apron and Chef Hats, Custom Aprons and more for Adults and Children", pp. 1-4 published by Bishop Aprons on the Internet at http://bishopaprons.com, publishing date unknown.

(Continued)

*Primary Examiner*—Amy B. Vanatta
(74) *Attorney, Agent, or Firm*—Thomas, Kayden, Horstemeyer & Risley, LLP

(57) ABSTRACT

An apron and method for using the same is provided. In one embodiment, the apron includes a body covering having an exterior facing side and an interior facing side. An elastic strap is attached to the interior facing side along a first side edge of the body covering. Also, a fastener is provided that has a first portion attached to a free end of the elastic strap and a second portion attached to the interior facing side along a second side edge of the body covering.

23 Claims, 2 Drawing Sheets

U.S. PATENT DOCUMENTS

| | | | | |
|---|---|---|---|---|
| 4,977,626 | A | 12/1990 | Smith | |
| 5,052,055 | A | 10/1991 | Mysliwiec | |
| 5,814,413 | A | 9/1998 | Beerwart | |
| D430,958 | S | 9/2000 | Stiff | |
| 6,202,215 | B1 * | 3/2001 | Sauter | 2/51 |
| 2002/0120973 | A1 | 9/2002 | D'Annunzio | |
| 2002/0138892 | A1 | 10/2002 | Drake | |

OTHER PUBLICATIONS

Author Unknown, "Bishop Aprons cooking gifts Paint Smock, Custom Aprons, Cooking Aprons for Kids and Adults", pp. 1-8, published by Bishop Aprons on the Internet at http://www.bishopaprons.com/ApronGallery.htm, publishing date unknown.

Milton, N., "Welcome to Birmingham Safety Wear", p. 1, published by Birmingham Safety Wear on the Internet at http://www.birminghamsafetywear.co.uk/Welcome.htm, publishing date Jan. 2001.

Milton, N., "BSW Online Catalogue-Aprons" p. 1-2, published by Birmingham Safety Wear on the Internet at http://www.birminghamsafetywear.co.uk/aprons.htm, publishing date Jan. 2001.

Author Unknown "J+L Hibbert Ltd.", p. 1, published by Hibberts on the Internet at http://www.ubd-online.co.nz/hibberts/home.cfm?This Path=hibberts%Findex%Ecfm, publishing date unknown.

Author Unknown, "J+L Hibbert Ltd"., pp. 1-5, published by Hibberts on the Internet at http://www.ubd-online.co.nz/hibberts/products.cfm, publishing date unknown.

Author Unknown, "Aprons", pp. 1-3, published by Food Industry Supplier, on the Internet at http://www.foodindustrysupplier.com/APRONS.HTM, publishing date unknown.

Author Unknown, "KochSupplies Inc.,—Products & Vendors", pp. 1-3, published by Koch Supplies on the Internet at http://kochsupplies.com/productvendor/Products.asp?, publishing date unknown.

Author Unknown, "Clothing" pp. 1-10, published by Koch Supplies on the Internet at http://www.kochsupplies.com, publishing date unknown.

Author Unknown, "PromoMall main page", p. 1, published by USAprons on the Internet at http://www.usaprons.com/main.cfm. publishing date unknown.

Author Unknown, "Full Size Image & Product Description", pp. 1-2, published by USAprons on the Internet at http://www.usaprons.com/product_detail.cfm?clinesid=USA00&cProductsNo=78 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=30 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=162& Img=, publishing date unknown.

Author Unknown, "Full Size Image & Description", pp. 1-2, published by USAprons on the Internet at http://www.usaprons.com/product detail.cfm?clinesid=USA00&cProductsNo=94 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=114 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=88 &Img=P, publishing date unknown.

Author Unknown, "Full Size Image & Product Description", pp. 1-2, published by USAprons on the Internet at http://www.usaprons.com/product_detail.cfm?clinessid=USA00&cProductsNo=169 &Img=, publishing date unknown.

Author Unknown, "Full Size Image & Description", pp. 1-2, published by USAprons on the Internet at http://www.usaprons.com/product_detail.cfm?clinesid=USA00&cProductsNo=165 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=161 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=98 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=110 &Img=, publishing date unknown.

Author Unknown, Full Size Image & Product Description, pp. 1-2, published by USAprons on the Internet at http://www.usaprons.com/product_detail.cfm?clinesid=USA00&cProductsNo=101 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=82 &Img=P, publishing date unknown.

Author Unknown, "Full Size Image & Product Description" pp. 1-2, published by USAprons on the Internet at http://www.usaprons.com/product_detail.cfm?clinesid=USA00&cProductsNo=86 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=204 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=47 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=62 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=121 &Img=, publishing date unknown.

Authur Unknown, "Full Size Image & Product Description", pp. 1-2, published by USAprons on the Internet at http://www.usaprons.com/product_detail.cfm?clinesid=USA00&cProductsNo=120 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=107 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=69 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=128 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=65 &Img=P, publishing date unknown.

Author Unknown, "Full Size Image & Product Description", pp. 1-2, published by USAprons on the Internet at http://www.usaprons.com/product_detail.cfm?clinesid=USA00&cProductsNo=119 &Img=, publishing date unknown.

Author Unknown, "Full Size Image & Product Description", pp. 1-2, published by USAprons on the Internet at http://www.usaprons.com/product_detail.cfm?clinesid=USA00&cProductsNo=95 &Img=P, publishing date unknown.

Author Unknown, "Full Size Image & Products Description", pp. 1-2, published by USAprons on the Internet at http://www.usaprons.

com/product_detail.cfm?clinesid=USA00&cProductsNo=43 &Img=P, publishing date unknown.
Author Unknown, "Full Size Image & Product Description", pp. 1-2, published by USAprons on the Internet at http://www.usaprons.com/products_detail.cfm?clinesid=USA00&cProductsNo=54 &Img=P, publishing date unknown.
Author Unknown, "Full Size Image & Product Description", pp. 1-2, published by USAprons on the Internet at http://www.usaprons.com/product_detail.cfm?clinesid=USA00&cProductsNo=31 &Img=P, publishing date unknown.
Author Unknown, "Full Size Image & Product Description", pp. 1-2, published by USAprons on the Internet at http://www.usaprons.com/product_detail.cfm?, clinesid=USA00&cProductsNo=74 &Img=P, publishing date unknown.
Author Unknown, "Full Size Image & Product Description", pp. 1-2, published by USAprons on the Internet at http://www.usaprons.com/product_detail.cfm?clinesid=USA00ProductsNo=132&Img=, publishing date unknown.
Author Unknown, "Full Size Image & Product Description", pp. 1-2, published by USAprons on the Internet at http://www.usaprons.com/product_detail.cfm?clinesid=USA00&cProductsNo=50 &Img=P, publishing date unknown.
Author Unknown, "Full Size Image & Product Description", pp. 1-2, published by USAprons on the Internet at http://www.usaprons.com/product_detail.cfm?clinesid=USA00&cProductsNo=59 &Img=P, publishing date unknown.
Author Unknown, Full Size Image & Product Description, pp. 1-2, published by USAprons on the Internet at http://www.usaprons.com/product_detail.cfm?clinesid=USA00&cProductsNo=160 &Img=, publishing date unknown.
Author Unknown, "Full Size Image & Product Description", pp. 1-2, published by USAprons on the Internet at http://www.usaprons.com/product_detail.cfm?clinesid=USA00&cProductsNo=125 &Img=, publishing date unknown.
Author Unknown, "Full Size Image & Products Description", pp. 1-2, published by USAprons on the Internet at http://www.usaprons.com/product_detail.cfm?clinesid=USA00&cProductsNo=203 &Img=, publishing date unknown.
Author Unknown, "Full Size Image & Product Description", pp. 1-2, published by USAprons on the Internet at http://www.usaprons.com/product_detail.cfm?clinesid=USA00&cProductsNo=39 &Img=P, publishing date unknown.
Author Unknown, "Full Size Image & Product Description", pp. 1-2. published by USAprons on the Internet at http://www.usaprons.com/product_detail.cfm?clinesid=USA00&cProductsNo=135 &Img=, publishing date unknown.
Author Unknown, "Full Size Image & Product Description", pp. 1-2, published by USAprons on the Internet at http://www.usaprons.com/product_detail.cfm?clinesid+USA00&cProductsNo=44 &Img=P, publishing date unknown.
Author Unknown, "Full Size Image & Product Description", pp. 1-2, published by USAprons on the Internet at http://www.usaprons.com/product_detail.cfm?clinesid=USA00&cProductsNo=35 &Img=P, publishing date unknown.
Author Unknown, "Full Size Image & Product Description", p. 1, published by USAprons on the Internet at http:/www.unaprons.com/product_detail.cfm?clinesid=USA00&cProductsNo=28&Img=P, publishing date unknown.
Author Unknown, "Full Size Image & Product Description", p. 1, published by USAprons on the Internet at http://www.usaprons.com/product_detail.cfm?clinesid=USA00&cProductsNo=136 &Img=, publishing date unknown.
Author Unknown,, "Full Size Image & Product Description", p. 1, published by USAprons on the Internet at http://www.usaprons.com/product_detail.cfm?clinesid=USA00&cProductsNo=201 &Img=, publishing date unknown.
Author Unknown, "Full Size Images & Product Description", p. 1, published by USAprons on the Internet at http://www.usaprons.com/product_detail.cfm?clinesid=USA00&cProductsNo=22 &Img=P, publishing date unknown.
Author Unknown, "Full Size Image & Product Description", p. 1, published by USAprons on the Internet at http://www.usaprons.com/product_detail.cfm?clinesid=USA00&cProductsNo=118 &Img=, publishing date unknown.
Author Unknown, "Full Size Image & Product Description", p. 1, published by USAprons on the Internet at http://www.usaprons.com/product_detail.cfm?clinesid+USA00&cProductsNo=202& Img=, publishing date unknown.
Author Unknown, "Full Size Image & Product Description", p. 1, published by USAprons on the Internet at http://www.usaprons.com/product_detail.cfm?clinesid=USA00&cProductsNo=200 &Img=, publishing date unknown.
Author Unknown, "Full Size Image & Product Description", pp. 1-2, published by USAprons on the Internet at http://www.usaprons.com/product_detail.cfm?clinesid=USA00&cProductsNo=198 &Img=, publishing date unknown.
Author Unknown, "Full Size Image & Product Description", pp. 1-2, published by USAprons on the Internet at http://www.usaprons.com/product_detail.cfm?clinesid=USA00&cProductsNo=32 &Img=P, publishing date unknown.
Author Unknown, Full Size Image & Product Description, pp. 1-2, published by USAprons on the Internet at http://www.usaprons.com/product_detail.cfm?=USA00&cProductsNo=199&Img=, publishing date unknown.
Author Unknown, "LaCrosse Safety Links" pp. 1-2, published by LaCrosse Safety on the Internet at http://www.lacrossesafety.com/links/asp., publishing date unknown.
Author Unknown, "LaCrosse Safety Products>Clothing", p. 1, published by LaCrosse Safety on the Internet at http://www.lacrossesafety.com/procuts/apron8.asp., publishing date unknown.
Author Unknown, "LaCrosse Safety Products>Clothing", pp. 1-2, published by LaCrosse Safety on the Internet at http://www.lacrossesafety.com/product/apron7.asp, publishing date unknown.
Author Unknown, "LaCrosse Safety Products>Clothing", p. 1, published by LaCrosse Safety on the Internet at http://www.lacrossesafety.com/product/apron6.asp, publishing date unknown.
Author Unknown, "LaCrosse Safety Products>Clothing", p. 1, published by LaCrosse Safety on the Internet at http://www.lacrossesafety.com/product/apron5.asp., publishing date unknown.
Author Unknown, "LaCrosse Safety Products>Clothing", p. 1, published by LaCrosses Safety on the Internet at http://www.lacrossesafety.com/product/apron4.asp., publishing date unknown.
Author Unknown, "LaCrosses Safety Products>Clothing," p. 1, published by LaCrosse Safety on the Internet at http://www.lacrossesafety.com/product/apron3.asp, publishing date unknown.
Author Unknown, "LaCrosses Safety Products>Clothing", p. 1-2, published by LaCrosse Safety on the Internet at http://www.lacrossesafety.com/product/apron2.asp, publishing date unknown.
Author Unknown, "LaCrosse Safety Products>Clothing", pp. 1-2, published by LaCrosse Safety on the Internet at http://www.lacrossesafety.com/product.apron1.asp, publishing date unknown.
Author Unknown, "LaCrosse Safety Products>Clothing", p. 1, published by LaCrosse Safety on the Internet at http://www.lacrossesafety.com/clothing.html, publishing date unknown.
Author Unknown, "Adjustable Strap Aprons-heavy duty 12-mil aprons ergonomically designed for comfort", pp. 1-2, published by Polyconversions on the Internet at http://www.polyconversions.com/adjustable_strap_aprons.htm, publlishing date unknown.
Author Unknown, "VR Grommet Aprons", pp. 1-3, published by Polyconversions on the Internet at http://www.polyconversions.com/asa_view.htm, publishing date unknown.
Author Unknown, "VR Die-Cut Aprons", pp. 1-3, published by Polyconversions on the Internet at http://www.polyconversions.com/dieCutClose1.htm, publishing date unknown.
Author Unknown, "VR Die-Cut Aprons", pp. 1-3, published by Polyconversions on the Internet at http://www.polyconversions.com/DieCutCloseUp.htm, publishing date unknown.
Author Unknown, "Personal Protective Aprons—Die Cut Aprons", pp. 1-3, published by Polyconversions on the Internet at http://www.polyconversions.com/DieCutAprons.htm, publishing date unknown.
Author Unknown, "VR Grommet Aprons", pp. 1-2, published by Polyconversions on the Internet at http://www.polyconversions.com/grommetBoyCloseUp.htm, publishing date unknown.

Author Unknown, "VR Grommet Aprons", pp. 1-2, published by Polyconversions on the Internet at http://www.polyconversions.com/grommetGirlCloseUp.htm, publishing date unknown.
Author Unknown, "VR Grommet Aprons", pp. 1-2, published by Polyconversions on the Internet at http://www.polyconversions.com/grommetCloseUp.htm, publishing date unknown.
Author Unknown, "Grommet Aprons—replacement for vinyl aprons", pp. 1-3, published by Polyconversions on the Internet at http://www.polyconversions.com/grommet Aprons.htm, publishing date unknown.
Author Unknown, "VR Protective Gowns—Personal Protective Apparel", pp. 1-2, published by Polyconversions on the Internet at http://www.polyconversions.com/ProtectiveGowenCloseUp.htm, publishing date unknown.
Author Unknown, "VR Protective Gowns—replaces vinyl, PC, Tyrek, neophrene gowns.", pp. 1-4, published by Polyconversions on the Internet at http://www.polyconversions.com/protectiveGowns.htm, publishing date unknown.
Author Unknown, "Personal Protective Apparel—Product Catalog", pp. 1-2, published by Polyconversions on the Internet at http://www.polyconversions.com/vrproductcatalog.htm, publishing date unknown.
Author Unknown, "Other Items" pp. 1-2, published by Azon Corporation on the Internet at http://www.azoncorporation.com/Other_itemsx.htm, publishing date unknown.
Author Unknown, "Other Items", pp. 1-2, published by Azon Corporation on the Internet at http://www.azoncorporation.com/Other_Itemsx.htm, publishing date unknown.
Author Unknown, "650BAB", p. 1, published by Azon Corporation on the Internet at http://www.azoncorporation.com/650BABx.htm, publishing date unknown.
Author Unknown, "540BAB", p. 1, published by Azon Corporation on the Internet at http://www.azoncorporation.com/540BABx.htm, publishing date unknown.
Author Unknown, "450BAB", p. 1, published by Azon Corporation on the Internet at http://www.azoncorporation.com/450BABx.htm, publishing date unknown.

* cited by examiner

APRON AND METHOD FOR USING THE SAME

BACKGROUND

In various industries such as the meat packing industry, aprons are worn to protect workers from being exposed to biological contaminants and to protect workers from other hazards. Unfortunately, it is usually the case that aprons include structural components such as straps, buttons, or other components that are attached to an apron in a manner that exposes such structural components to biological material or other hazardous materials. In some situations, biological material or other hazardous materials may collect in small pockets or recesses presented by such exposed structural components. Unfortunately, such material may stay embedded within the pockets or recesses even though the apron is washed repeatedly. This ultimately presents a health hazard to workers.

BRIEF DESCRIPTION OF THE SEVERAL VIEWS OF THE DRAWINGS

The invention can be understood with reference to the following drawings. The components in the drawings are not necessarily to scale. Also, in the drawings, like reference numerals designate corresponding parts throughout the several views.

DETAILED DESCRIPTION

Figure 1:
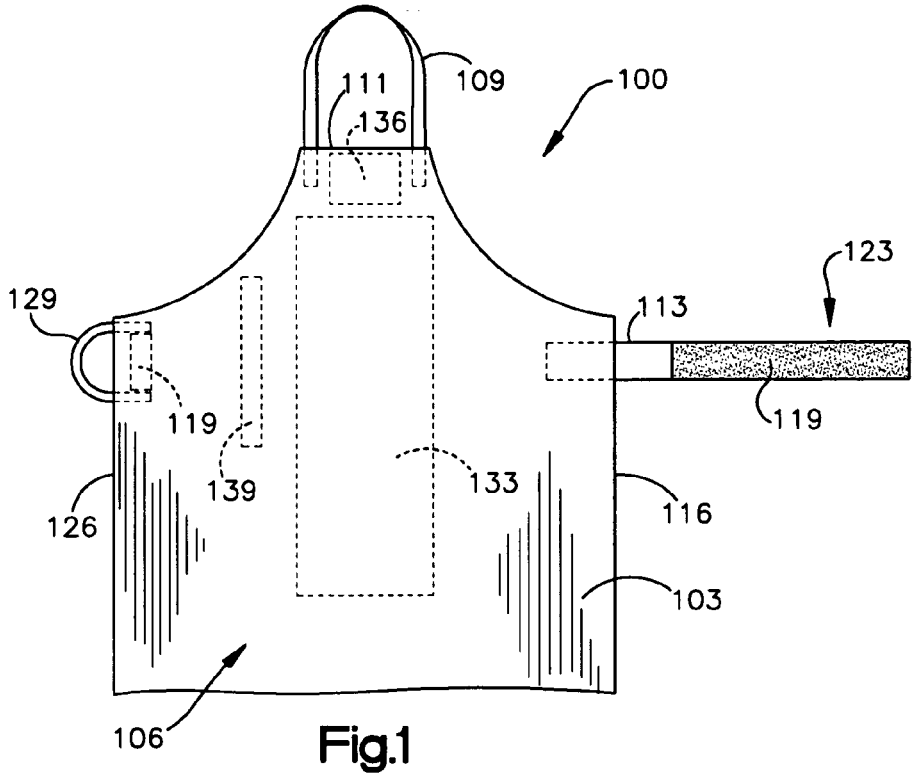
FIG. 1 is a front view of an apron according to an embodiment of the present invention.

With reference to FIG. 1, shown is an apron 100 according to an embodiment of the present invention. The apron 100 includes a body covering 103 that covers the front of a wearer's body when worn and wraps around both sides of the wearer. The body covering 100 includes an exterior facing side 106 and an interior facing side (not shown). The exterior facing side 106 is seen when the apron 100 when worn by an individual. The interior facing side faces the user and is against the wearer's body when the apron 100 is worn. The body covering 103 may be constructed from any one of a number of materials. The edges of the body covering 103 may be conditioned to prevent unraveling. Such conditioning may include stitching or cauterizing, etc.

In one embodiment, the body covering 103 is constructed from a material that is impermeable to water or other fluids. In another embodiment, the body covering 103 may be constructed from a material that is resistant to penetration by sharp objects such as knives, etc. Examples of various materials that may be used to construct the body covering 103 include nylon, canvas, fibers comprising a plurality of long molecular chains produced from poly-praraphenylene terephthalamide (KEVLAR™) and other appropriate materials.

A number of components are attached to the body covering 100. In one embodiment, all of the components are attached only to the interior facing side of the apron 100. In this respect, the exterior facing side 106 of the body covering 103 is free of any protruding portion of any of the components attached to the body covering 103.

The components may include, for example, a neck strap 109 that is fastened to the interior facing side of the body covering 100 and extends from a top side edge 113 of the body covering 103. The neck strap 109 may be a single strap or two straps that are tied together to form a loop that is placed around an individual's neck when the apron 100 is worn. The neck strap 109 may be made of various materials such as, for example, nylon, cotton, leather, polypropylene materials, and other materials.

The components attached to the body covering 103 also include, for example, an elastic strap 113 is attached to the interior facing side along a first side edge 116 of the body covering 103. The elastic strap 113 is flexible and stretches to various lengths. In this respect, the elastic strap 113 may be made from an elastic material such as, for example, knitted elastic material, and other appropriate elastic material.

The apron 100 includes a fastener 119 that comprises a first portion attached to a free end 123 of the elastic strap 113 and a second portion attached to the interior facing side along a second side edge 126 of the body covering 100. In one embodiment, the fastener 119 may be, for example, a hook and loop structure (i.e. Velcro™), a hook and ring, a buckle, a snap and receptacle, or other type of fastener.

In another embodiment, the apron 100 features a handle loop strap 129 that is attached to the interior facing side along the second side edge 126 of the body covering 103. In this respect, at least one end of the handle loop strap 129 is positioned so as to be attached to the body covering 103 at a location that is adjacent to the second portion of the fastener 119.

In still another embodiment, the apron 100 may include an optional protective panel 133 that is affixed to a center portion of the body covering 103. In this respect, the protective panel 133 is affixed to the interior facing side of the body covering 103 so as to prevent exposure to contaminants that come into contact with the apron 100. The protective panel 133 may be removable from the body covering 103 by using an appropriate fastening medium such as a hook and loop structure, etc. Alternatively, the protective panel 133 may be permanently affixed to the interior facing side of the body covering 103 by stitching, etc. In still another embodiment, the protective panel 133 may be affixed to the exterior facing side of the body covering 103. However, such an approach may create seams or other structures that allow the collection of contaminants.

The apron 100 may include a pocket 136 that is attached to the interior facing side of the body covering 103. In one embodiment, the pocket 136 is positioned along the top side edge 111 of the body covering 103. When so positioned, the pocket 136 is thus made accessible to an individual when the apron is worn thereby to hold various items such as writing instruments, papers, or other items. Due to the fact that the pocket 136 is attached to the interior facing side of the body covering 103, all items placed therein are protected from exposure to contaminants that may come into contact with the exterior facing side 106 of the apron 100 when worn by an individual.

In another embodiment, the apron 100 also includes second fastening portion 139 that holds a portion of the free end 123 of the elastic strap 113 that extends beyond the second portion of the fastener 119. The second fastening portion 139 may be, for example, a portion of a hook and loop structure that mates with the portion of the fastener 119 attached to the free end 123 of the elastic strap 113.

The various components such as the neck strap 109, the elastic strap 113, the second portion of the fastener 119, the handle loop strap 129, the protective panel 133, the pocket 136, and the second fastening portion 139 may be attached to the interior facing side of the body covering 103 in one of a number of ways. For example, these components may be stitched to the body covering 103 or may be attached using a suitable adhesive. Alternatively, a melt-press method may be employed if the materials that make up the body covering 103 and the components facilitate such an approach. Alternatively, the components may be attached using any other suitable method.

The apron 100 may be employed in various industries for the protection of workers and in other environments. For example, the apron 100 may be employed in the meat packing industry or in environments where chemicals are handled, etc.

Figure 2:
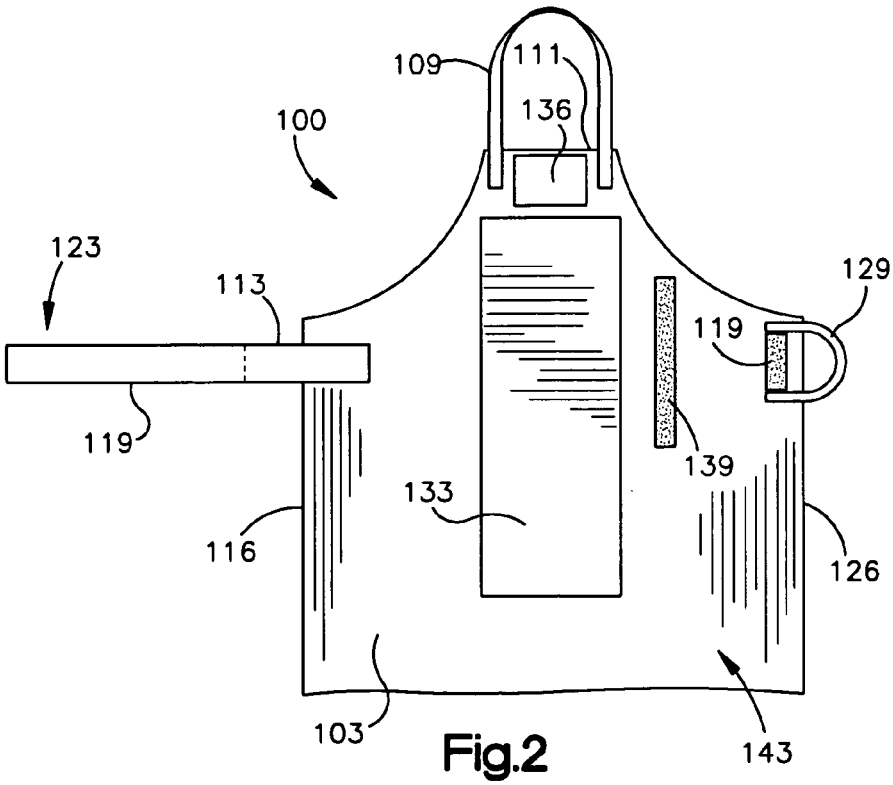
FIG. 2 is a rear view of the apron of FIG. 1 according to an embodiment of the present invention.

Referring next to FIG. 2, shown is a view of the apron 100 that displays the interior facing side 143. As shown, the neck strap 109, the elastic strap 113, the second portion of the fastener 119, the handle loop strap 129, the protective panel 133, the pocket 136, and the second fastening portion 139 are shown attached to the interior facing side 143 as discussed above. In view of the discussion with reference to FIG. 1 and FIG. 2 above, next the actual use and benefits of the apron 103 are discussed.

In order to wear the apron 100, the user first places the neck strap 109 around their neck. Thereafter, the free end 123 of the elastic strap 113 is wrapped around the wearer's body. In this respect, the first side edge 116 is also wrapped against the wearer at or near the back of the wearer. The free end 123 of the elastic strap 113 may be held against the front side of the user as far as it will reach. In those embodiments that include the second fastening portion 139, the portion of the fastener 119 attached to the free end 123 of the elastic strap 113 may be mated with the second fastening portion 139 to hold the free end 123 in a horizontal direction against the body. Then, the wearer mates the second portion of the fastener 119 to the first portion of the fastener 119. The mating of the first and second portions of the fastener 119 is accomplished at a location between the body covering 103 of the apron 100 and the wearer.

In this respect, the apron 100 is thus worn by an individual. In embodiments that do not include the second fastening portion 139, the free end 123 of the elastic strap 113 may dangle freely between the interior facing side 143 and the wearer after the first and second portions of the fastener 119 are mated.

The fact that the elastic strap 113 is flexible facilitates the use of the apron 100 with different wearers of varying girth. Also, when the apron is worn such that it is fit snuggly around the torso of an individual, the elastic strap 113 allows an individual to bend over without stressing the mating between the first and second portions of the fastener 119. The second fastener portion 139 makes the apron 100 easier for an individual to put on, although the apron 100 may be worn without the second fastener portion 139.

The handle loop strap 129 provides a loop for a user to grasp to remove the apron 100 after putting it on. Specifically, the user may grasp the handle loop strap 129 and pull the handle loop strap 129 to decouple the mated first and second portions of the fastener 119 apart to take off the apron 100. In another embodiment, the apron 100 may not include the handle loop strap 129. In such case, the wearer would grasp the second side edge 126 of the body covering 103 and pull the second side edge 126 of the body covering 103 to decouple the first and second portions of the fastener 119 to take off the apron 100.

Where the protective panel 133 is included in the apron 100, it provides for greater protection of the front side of a wearer. Such may be desirable, for example, where the apron 100 is employed in meat packing environments in which the use of knives and other sharp instruments is common. In this respect, the protective panel 133 may be constructed from a material that provides for greater puncture and cut resistance such as Kevlar, etc.

In addition, due to the fact that all of the components such as the neck strap 109, the elastic strap 113, the second portion of the fastener 119, the handle loop strap 129, the protective panel 133, the pocket 136, and the second fastening portion 139 are attached to the interior facing side 143 of the apron 100, there are no pits or recesses created where such components are attached to the body covering 103 that are exposed to biological contaminants or other contaminants when worn by the user. Specifically, the attachment of such components is advantageously tucked between the interior facing side 143 of the apron 100 and the body of the wearer.

In addition, the materials from which the body covering 103, the neck strap 109, the elastic strap 113, the second portion of the fastener 119, the handle loop strap 129, the protective panel 133, the pocket 136, and the second fastening portion 139 are constructed can withstand at least 100 wash/dry cycles without substantial or unacceptable degradation. Substantial or unacceptable degradation is defined herein as tearing, staining, or a loss of impermeability to water or other fluids as determined using a seepage test of at least 10 minutes in which the fabric is placed in glass with an amount of water contained by the material.

In order to provide for this benchmark, actual testing has been performed in which an example of the apron 100 was repeatedly washed and dried 102 times in a Whirlpool super capacity washer, Model LA5668XS, and a Whirlpool automatic dryer, Model LAE5910, both the washer and dryer being manufactured by Whirlpool Corporation of Benton Harbor, Mich. Each washing cycle was 10 minutes long for a total of approximately 17 hours of washing. The material employed as the body covering 103 in this test was Nylon. After the 102 cycles, no loss of impermeability to water or other fluids was detected using the seepage tests discussed above.

In a second test a total of 88 wash and dry cycles were performed on an example of the apron 100 constructed from Nylon using a Maytag Oversize Capacity Plus washer, Model MAV6000AWN (manufactured by Maytag Corporation of Newton, Iowa), set for three 8 minute normal cycles and a General Electric four cycle dryer, Model DDE5508 MBLWH (Manufactured by General Electric Company of Louisville, Ky.), set for a normal drying cycle of 20 minutes. This test was performed while the apron 100 was exposed to pig blood to test blood stain removal (to simulate meat packing applications) and to test leak proof capability. The apron was exposed to the blood 20 times during the course of the 88 wash and dry cycles. Each blood soaking was performed for 8 hours. The leak test was performed for 8 hours after the 88 wash/dry cycles. In each of the wash cycles, bleach was employed with laundry detergent to help remove the blood stains. After the 88 cycles, no loss of impermeability to water or other fluids was detected using the seepage tests discussed above. Also, the blood stains were substantially removed by standard wash cycles.

Figure 3:
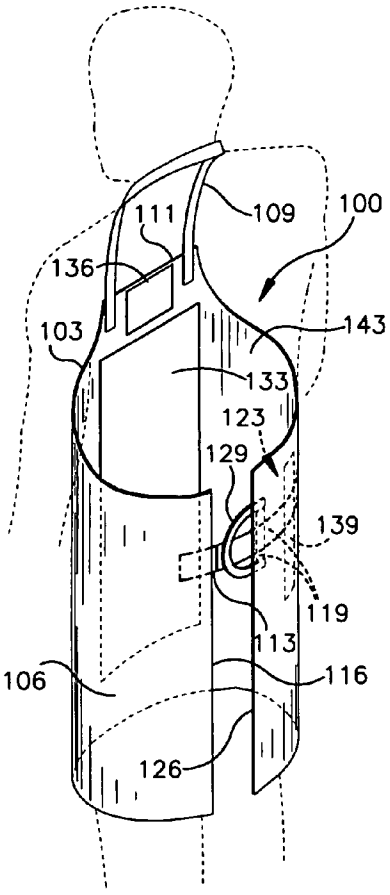
FIG. 3 is a rear perspective view of the apron of FIG. 1 as it is worn by an individual according to an embodiment of the present invention.

Referring next to FIG. 3, shown is the apron 100 as it is worn by an individual (shown in phantom). As seen, the first and second portions of fastener 119 are mated so as to hold the apron 100 onto the individual. The first portion of the fastener 119 on the free end 123 of the elastic strap 113 is also mated with the second fastening portion 139. Where the second fastening portion 139 is not employed, the length of the free end 123 of the elastic strap 113 that extends beyond the second portion of the fastener 119 may dangle freely.

Figure 4:
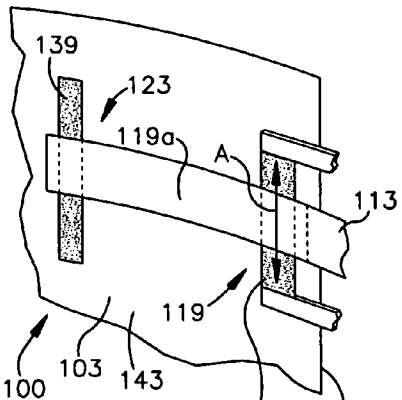
FIG. 4 is a partial cutaway view of a portion of the apron of FIG. 1 according to an embodiment of the present invention.

With reference to FIG. 4, shown is a cutaway portion of the interior facing side of the apron 100 that illustrates the mating between the first and second portions of the fastener 119 when worn by an individual, where the fastener 119 is a hook and loop structure. In this respect, the first portion is denoted as first portion 119*a* and the second portion is denoted as second portion 119*b*. The first portion 119*a* extends for a predetermined length that may be, for example, two-thirds (⅔) of the entire length of the elastic strap 113. Alternatively, the length of the first portion 119*a* may be some other proportion of the elastic strap 113. Also, the second portion 119*b* includes a length that extends along a longitudinal axis A. In one embodiment, the second portion 119*b* is attached to the interior facing side 143 such that the longitudinal axis A is aligned with the second side edge of the body covering 103. In this respect, the first portion 119*a* and the second portion 119*b* of the fastener 119 are arranged orthogonal with respect to each other when the apron 100 is worn by an individual.

This helps accommodate wearers of varying height and girth. Specifically, the length of the first portion 119*a* of the fastener 119 facilitates wearers of large and small girth. The elasticity of the elastic strap 113 allows such wearers to bend over without stressing or breaking the mating of the first and second portions 119*a* and 119*b*. The length of the second portion 119*b* facilitates the use of the apron 100 with wearers of varying height. Also, by virtue of the fact that the first and second portions 119*a* and 119*b* are positioned orthogonal to each other, it is easier for a given wearer to properly mate the first and second portions 119*a* and 119*b* when putting on the apron 100. Specifically, there is much greater room for proper mating of the first and second portions 119*a* and 119*b*.

In one embodiment, the length of the first portion 119*a* that extends along a longitudinal direction of the elastic strap 113 is greater than a width of the first portion 119*a*. Also, the second portion 119*b* of the fastener 119 includes a length along the longitudinal axis A that is greater than a width of the first portion 119*a* of the fastener 119. In this respect, a minimum contact area between the first and second portions 119*a* and 119*b* may be maintained when the first and second portions 119*a* and 119*b* are fully engaged. This minimum contact area may be that which is necessary to provide for enough holding force to prevent the bond between the first and second portions 119*a* and 119*b* from being broken due to the normal activity of the wearer in bending over, reaching, etc. The minimum contact area may be, for example, approximately 2 square inches or some other amount of area.

Figure 5:
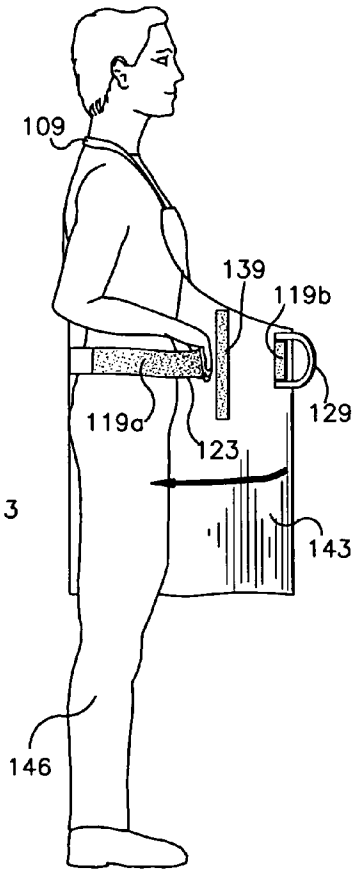
FIG. 5 is a side perspective view of a wearer putting on the apron of FIG. 1 according to an embodiment of the present invention.

Referring next to FIG. 5, shown is a view of an individual 146 that is putting on the apron 100. As shown, the free end 123 of the elastic strap 113 may be mated with the second fastening portion 139 and then the rest of the apron 100 may be wrapped around the remaining exposed portion of the wearer's body and the first and second portions of the fastener 119 may be mated accordingly.

Figure 6:
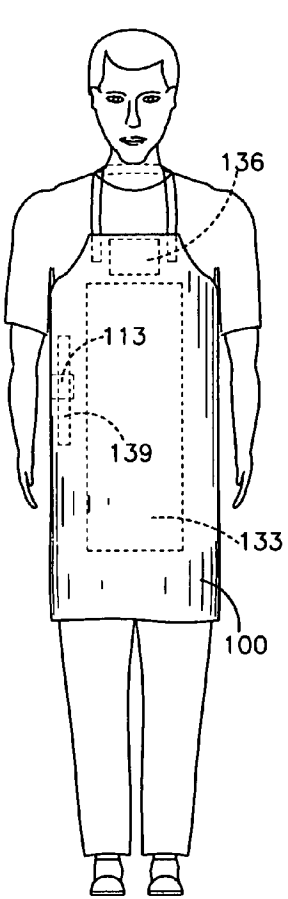
FIG. 6 is a front perspective view of an individual wearing the apron of FIG. 1 according to an embodiment of the present invention.

With reference to FIG. 6, shown is a frontal view of the apron 100 as it is worn by an individual 146.

Although the invention is shown and described with respect to certain embodiments, it is obvious that equivalents and modifications will occur to others skilled in the art upon the reading and understanding of the specification. The present invention includes all such equivalents and modifications, and is limited only by the scope of the claims.

What is claimed is:

1. An apron, comprising:

a body covering having an exterior facing side and an interior facing side;

an elastic strap permanently attached to the interior facing side along a first side edge of the body covering;

a fastener having a first portion attached to a free end of the elastic strap and a second portion permanently attached to the interior facing side along a second side edge of the body covering, the second portion being exposed solely on the interior facing side; and wherein an entire mating of the first and second portions of the fastener occurs on the interior facing side of the body covering, thereby positioning the entire mating between the body covering and a wearer of the apron.

2. The apron of claim 1, further comprising:

a neck loop strap extending from a top side edge of the body covering, the neck loop strap being attached to an interior facing side of the body covering; and wherein the exterior facing side of the body covering is free of any protruding portion of the elastic strap, the neck loop strap, and the second portion of the fastener.

3. The apron of claim 1, wherein the fastener further comprises a hook and ring.

4. The apron of claim 1, wherein the fastener further comprises a hook and loop structure.

5. The apron of claim 4, wherein the first portion and second portion of the fastener are positioned orthogonal with respect to each other.

6. The apron of claim 5, wherein the second portion of the fastener includes a longitudinal axis, and the second portion is attached to the interior facing side such that the longitudinal axis is aligned with the second side edge of the body covering.

7. The apron of claim 5, wherein the first portion of the fastener includes a length along a longitudinal direction of the elastic strap that is greater than a width of the first portion of the fastener.

8. The apron of claim 5, wherein the second portion of the fastener includes a length along a longitudinal axis that is greater than a width of the first portion of the fastener.

9. The apron of claim 5, wherein the first portion and second portion of the fastener facilitate a minimum contact area of approximately 2 square inches.

10. The apron of claim 1, further comprising a neck loop strap extending from a top side edge of the body covering.

11. The apron of claim 10, wherein the neck loop strap is attached to an interior facing side of the body covering.

12. The apron of claim 1, further comprising a handle loop strap attached to the interior facing side along the second side edge of the body covering.

13. The apron of claim 1, further comprising a protective panel affixed to a center portion of the body covering.

14. The apron of claim 13, wherein the protective panel is affixed to a center portion of the interior facing side of the body covering.

15. The apron of claim 1, further comprising a pocket attached to the interior facing side and positioned along a top side edge of the body covering.

16. The apron of claim 1, wherein the apron is constructed using fibers comprising a plurality of long molecular chains produced from poly-praraphenylene terephthalamide.

17. The apron of claim 1, wherein the apron is constructed from a material that withstands at least 100 wash and dry cycles without substantial degradation.

18. An apron, comprising:

a body covering having an exterior facing side and an interior facing side;

an elastic strap permanently attached to the interior facing side along a first side edge of the body covering;

a first fastening means for removably attaching the elastic strap to a side of the body covering opposing the first side edge of the body covering, the first fastening means including a first portion attached to a free end of the elastic strap and a second portion permanently attached to the interior facing side along a second side edge of the body covering, the second portion being exposed solely on the interior facing side; and wherein an entire mating of the first and second portions of the fastener occurs on the interior facing side of the body covering, thereby positioning the entire mating between the body covering and a wearer of the apron.

19. A method for wearing an apron that includes a body covering having an exterior facing side and an interior facing side, an elastic strap attached to the interior facing side along a first side edge of the body covering, and a fastener having a first portion attached to a free end of the elastic strap and a second portion attached to the interior facing side along a second side edge of the body covering, the method comprising the steps of:

positioning a neck loop strap of the apron about a neck of a wearer, wherein the interior facing side of the apron is positioned against the wearer; and mating the first portion of the fastener to the second portion of the fastener at a location between the body covering of the apron and the wearer, wherein the entire mating between the first and second portions of the fastener is positioned between the body covering of the apron and the wearer, and the second portion of the fastener being exposed solely on the interior facing side.

20. The method of claim 19, wherein the step of mating the first portion of the fastener to the second portion of the fastener at the location between the body covering of the apron and the wearer further comprises the step of mating a hook and a loop of a hook and loop structure.

21. The method of claim 20, further comprising the steps of:

grasping the second side edge of the body covering; and pulling the second side edge of the body covering to decouple the first and second portions of the fastener.

22. The method of claim 20, further comprising the steps of:

grasping a handle loop strap attached to the interior facing side along the second side edge of the body covering; and pulling the handle loop strap to decouple the first and second portions of the fastener.

23. The method of claim 19, further comprising the step of affixing a protective panel to a center portion of the body covering.

* * * * *